United States Patent [19]

Tarnacki

[11] 4,014,453

[45] Mar. 29, 1977

[54] PAINT BRUSH HOLDER

[76] Inventor: Edward Joseph Tarnacki, 408 Hudson St., Jermyn, Pa. 18433

[22] Filed: May 20, 1976

[21] Appl. No.: 688,377

[52] U.S. Cl. ..... 220/90; 248/110

[51] Int. Cl.[2] ..... B44D 3/12; B65D 25/00

[58] Field of Search ..... 15/257.05, 260, 261, 15/263; 206/361; 220/90; 401/121; D4/289

[56] References Cited

UNITED STATES PATENTS

| | | | |
|---|---|---|---|
| 1,734,976 | 11/1929 | McClellan | 220/90 |
| 2,535,260 | 12/1950 | Braswell | 220/90 |
| 2,542,737 | 2/1951 | Vogel | 220/90 |
| 2,567,326 | 9/1951 | Entsminger | 220/90 |
| 3,948,413 | 4/1976 | Gorrell et al. | 220/90 |
| 3,980,264 | 9/1976 | Tomasik | 248/110 X |

*Primary Examiner*—Daniel Blum
*Attorney, Agent, or Firm*—Frederick E. Bartholy

[57] ABSTRACT

A holder for paint brushes which is adapted to rest over the rim of an open paint can is described. The holder has a vertically-extending forked member for freely supporting a brush at the narrow portion of the handle thereof, and a downwardly-extending curvilinear portion forming a trough surrounding the bristles of the brush, the upwardly-extending rim of the trough has a rounded edge for removal of excess paint from the brush.

5 Claims, 3 Drawing Figures

PAINT BRUSH HOLDER

This invention is directed to a holder for paint brushes which has the purpose of facilitating the use and handling of the brush while painting. It is particularly effective when large surfaces requiring repeated immersion of the brush by the user are to be painted.

In painting a wall, or any large object, it is customary to utilize the can in which the paint is purchased as a container. Needless to say, when the bursh is immersed in the can, the user must be careful not to allow too much paint to be soaked up by the brush in order to avoid splattering and dripping. This is a tedious and time-consuming operation. Another alternative is to press the brush against some object to remove excess paint after each immersion. In most cases this is accomplished by wiping the brush against the inner edge of a can into which some paint has been poured from the full can. In both types of procedures this entails waste and splattering.

Accordingly, it is the primary object of the invention to provide a simple holder for the paint brush which, while it is used, may be placed over the rim of a can containing a fair amount of paint and serves as an aid to the painter by virtue of its variety of functions.

A particular feature of the invention is that the brush holder constructed in accordance therewith is extremely simple and inexpensive to produce.

It is a particular advantage of the invention that the holder attached to a can may be left therein after use. By removing the paint from the can and refilling it with a cleaning agent, the holder may serve as a repository for the brush to be soaked in the cleaning solution.

Other objects, features, and advantages will be apparent from the following detailed description of the invention, pointed out in particularity in the appended claims and taken in connection with the accompanying drawing, in which:

Figure 1:
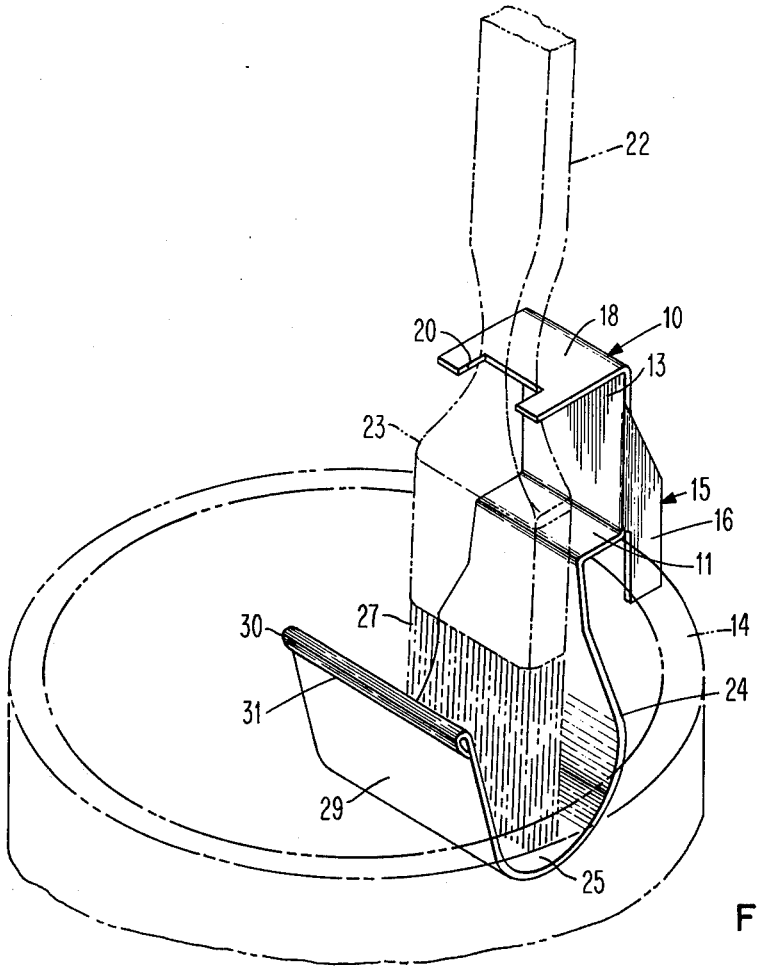
FIG. 1 is a perspective view of the holder as it is supported on a can, the latter being indicated in phantom lines together with a brush held by it similarly shown.
Figure 2:
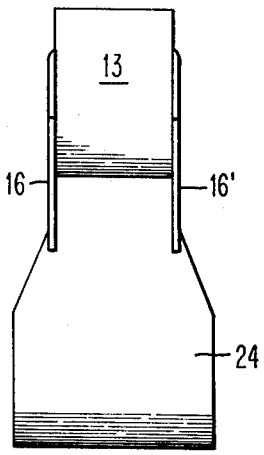
FIG. 2 is a rear view of the holder.
Figure 3:
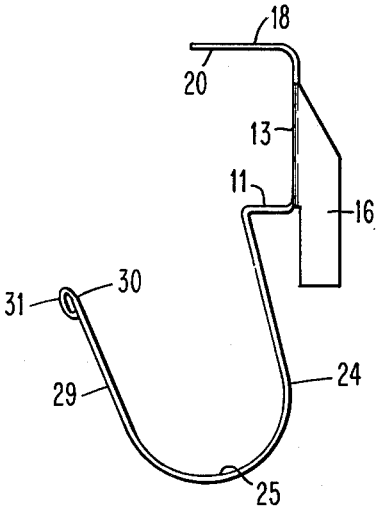
FIG. 3 is a side view thereof.

Referring to the Figures, it is seen that the holder 10 is made of a flat piece of pliable material bent into a particular configuration. It includes a platform 11, the width of which is so dimensioned as to fit the rim of a standard size paint can 14 so that it may rest thereon. The outer edge of the platform 11 terminates in an upwardly-extending wall 13.

A forked member 15, secured to the outer side of the wall 13 consists of a pair of downwardly-extending legs 16 and 16' which serve to contact the side of the can 14 and thereby support the platform 11 solidly on the rim of the can 14.

The upwardly-extending wall 13 is bent back to form a support member 18 which extends inwardly of the can 14. A cutout 20 is provided in the member 18 which is so dimensioned as to accept the narrow portion of the inwardly-curved formation of the handle 22 of the brush 23.

Extending downwardly from the inner edge of the platform 11 is a flat curvilinear portion 24 contacting the wall of the can and forming a trough which accepts the bristles 27 of the brush 23. The trough 25 terminates in an upwardly-turned side 29 of which the edge 30 is turned back to form a rounded smooth surface at 31.

In use, the holder 10 is secured to the can by simply pressing down so that the platform 11 lies flat on the rim of the can, the members 15 contact and the outer side and the portion 24 contact the inside thereof. Sufficient paint is poured into the can to cover the bristles 27 of the brush 23. The holder is so dimensioned that in the above condition the edge 30 of the trough 24 extends above the level of the paint.

The user removes the bursh 23 from the cutout 20 and draws it smoothly over the edge 30 to remove as much paint from the bristles 27 as he may desire. The excess paint, so removed, drips back into the can. The brush 23 now has the right amount of paint without dripping.

After using up the paint in the bristles, the brush 23 is simply inserted in the trough 24 to take up paint and again placed against the edge 30 to remove the excess paint. After the painting task is completed, the brush 23 is replaced in the holder 10 until further use.

The holder 10 with the brush 23 may be placed over another can containing a cleansing solution to soak until further use is to be made thereof.

It is seen from the above description that the holder 10 may be fabricated from one sheet of pliable material — be it metal or plastic — by providing the bends which result in the trough 24, the platform 11, the wall 13, and the support member 18. The legs 16 and 16' of the forked member 15 may be portions integral to the wall 13, being simply bent back 90°. Of course the holder 10 may also be molded of suitable plastic material, or stamped by a punch press in two simple operations, one being the stamping of the outline from one flat sheet of material and the other, by the use of a blanking die for stamping the form thereof.

The invention in its broader aspects is not limited to the specific embodiments herein shown and described but changes may be made within the scope of the accompanying claims without departing from the principles of the invention and without sacrificing its chief advantages.

What is claimed is:

1. A holder for paint brushes consisting of a platform to rest over the rim of a paint can, clamping members extending downwardly from the outer edge of said platform and over the outer side of said can, a wall extending upwardly from said platform having a portion bent at a right angle extending over said can, means in said portion for securing the handle of a brush and a curvilinearly-shaped portion extending from the inner edge of said platform downwardly into said can and engaging the same and forming a trough accepting the bristles of said brush, said trough having an upwardly-extending portion terminating in a rim adapted for the removal of excess paint from said brush, the cooperation of the clamping members and curvilinear-shaped portion securing the holder to the can.

2. A holder in accordance with claim 1 wherein said clamping members comprise legs secured to said upwardly-extending wall.

3. A holder in accordance with claim 1 wherein said means for securing the handle of said brushes comprises a cutout in said wall portion extending over said can.

4. A holder in accordance with claim 3 wherein said cutout of said wall portion is so dimensioned as to accept the inwardly-curved formation of said handle.

5. A holder in accordance with claim 1 wherein said platform, said wall, and clamping means, and said trough consist of a solid piece of pliable material cut and bent into the form defined.

* * * * *